US006648765B2

(12) United States Patent
Ehmes et al.

(10) Patent No.: US 6,648,765 B2
(45) Date of Patent: Nov. 18, 2003

(54) SUPPORTING DEVICE FOR A PLURALITY OF ADAPTER CHUCKS

(75) Inventors: Ulrich Ehmes, Oporto (PT); Bernd Schaub, Delaes (PT)

(73) Assignee: Leica Camera AG, Solms (DE)

( * ) Notice: Subject to any disclaimer, the term of this patent is extended or adjusted under 35 U.S.C. 154(b) by 0 days.

(21) Appl. No.: 09/984,579

(22) Filed: Oct. 30, 2001

(65) Prior Publication Data

US 2002/0052177 A1 May 2, 2002

(30) Foreign Application Priority Data

Oct. 31, 2000 (DE) ..... 100 53 977

(51) Int. Cl.[7] ..... B24B 1/00

(52) U.S. Cl. ..... 464/179; 451/271; 451/291; 451/292; 451/472; 451/473; 451/482; 451/483; 464/185

(58) Field of Search ..... 464/179, 185; 451/270, 271, 291, 292, 470, 472, 473, 471, 482, 483

(56) References Cited

U.S. PATENT DOCUMENTS

| | | | | | |
|---|---|---|---|---|---|
| 1,697,990 | A | * | 1/1929 | Maynard | 451/285 |
| 1,756,014 | A | * | 4/1930 | Streby | 451/246 |
| 2,105,753 | A | * | 1/1938 | Ortegren | 451/157 |
| 2,105,762 | A | * | 1/1938 | Zimmerman | 451/157 |
| 2,141,491 | A | * | 12/1938 | Searles | 451/246 |
| 2,393,207 | A | * | 1/1946 | Wallace | 451/285 |
| 2,509,211 | A | | 5/1950 | Clement | 51/277 |
| 6,110,017 | A | * | 8/2000 | Savoie et al. | 451/42 |

FOREIGN PATENT DOCUMENTS

| | | |
|---|---|---|
| DE | 198 12 186 | 9/1999 |
| DE | 100 03 291 | 8/2001 |
| EP | 0 169 931 | 2/1986 |

* cited by examiner

*Primary Examiner*—Lynne H. Browne
*Assistant Examiner*—Kenn Thompson
(74) *Attorney, Agent, or Firm*—Foley & Lardner

(57) ABSTRACT

A supporting device for a plurality of adapter chucks for the precision grinding or polishing of optical components comprises a spindle shaft having a central bore for supplying one of a gas and a vacuum, at least one arm adjustably supported by a head of the spindle shaft and having a seating for an adapter chuck, and a flexible vacuum/gas line provided between the seating and the spindle shaft. The arm is adjustable as to its angle of inclination relative to an axis of the spindle shaft.

12 Claims, 1 Drawing Sheet

SUPPORTING DEVICE FOR A PLURALITY OF ADAPTER CHUCKS

CROSS-REFERENCE TO RELATED PATENT APPLICATIONS

Germany Priority Application 100 53 977.7, filed Oct. 31, 2000 and including the specification, drawings, claims, and abstract, is incorporated herein by reference in its entirety.

BACKGROUND OF THE INVENTION

The present invention relates to a supporting device for a plurality of adapter chucks for the precision grinding and/or polishing of surfaces of optical components, the receiving chucks being provided with a vacuum/gas connector and the supporting device comprising a spindle shaft having a central bore for the supply of vacuum/gas.

An adapter chuck of this type for the machining of individual lenses is known from DE 198 12 186 A1. A supporting device having a plurality of such adapter chucks is described in DE 100 03 291.5. The supporting device consists of a base body and a lid portion. Set into the lid portion are a plurality of the adapter chucks, which contain elastic supporting elements for the lens rests. The supporting elements are adapted via a vacuum/gas supply to the bearing surfaces of the optical components to be machined.

The top of the lid is spherically adapted to the radius of a grinding or polishing tool. The components lying in the adapter chuck, such as, for example, convex or concave lenses, are pressed by means of the supporting elements, by the surface to be machined, against the hemispherical grinding or polishing tool. The adapter chuck with the elastic supporting elements can be fixedly set into the lid portion. However, it may also be rotatably mounted in the lid portion, via a cylindrical holder. A plurality of adapter chucks may be retained in the lid portion symmetrically to the axis of the spindle.

The lid portion may be fixed interchangeably on the base body in order to permit an adaptation of the system to different radii of the hemispherical grinding or polishing tools. The expense in material and time required to produce the lid portions is substantial, since lid portions have to be provided not only for different machining radii but also different diameters of the adapter chucks. This increases the storage space required. The setup times for changing the lid portions are non-negligible, in particular in the case of short machining runs.

SUMMARY OF THE INVENTION

It was therefore an object of the invention, while retaining the multiple arrangement of adapter chucks of the type described, to expedite adaptation to different machining radii and reduce the effort involved in storing adapter chucks.

The present invention provides for a supporting device for a plurality of adapter chucks for the precision grinding or polishing of optical components, comprising: a spindle shaft having a central bore for supplying one of a gas and a vacuum; at least one arm adjustably supported by a head of the spindle shaft, adjustable as to its angle of inclination relative to an axis of the spindle shaft, and having a seating for an adapter chuck; and a flexible vacuum/gas line provided between the seating and the spindle shaft.

In a further aspect, the supporting device further comprises a supporting plate, approximately symmetric relative to the axis of the spindle shaft, movably connected to the spindle shaft.

In another aspect, the support device further comprises supports of the same number of arms, fixed on the periphery of the supporting plate, on each of which an outer end of a corresponding arm is pivotably connected.

In yet another aspect, a circumferential groove approximately perpendicular to the axis of the spindle shaft is provided on the head of the spindle shaft, in which an inner end of each arm is pivotably supported.

As a result of the disposition of angularly adjustable arms having seatings for the adapter chucks and a flexible vacuum/gas connector between the seatings and the spindle shaft, the production and storage of different lid portions is eliminated. The seatings in the arms can be adapted in a simple manner to the fixing portions of conventional adapter chucks with elastic supporting elements for individual lens machining. The angular adjustment of the arms permits rapid adaptation of the position of the adapter chuck to suit different radii of the hemispherical grinding or polishing tools. As a result of a suitable design of the angular adjustment, the position of the arms can be adapted to both convexly and concavely curved hemispherical grinding or polishing tools. Varying the size and number of the arms permits simple adaptation to adapter chucks of different diameters.

By adjusting the supporting plate with respect to the spindle shaft, the bearings on the supports can be brought continuously from a position above the groove (corresponding to a convexly curved tool) into a position below the groove (corresponding to a concavely curved tool). The direction of the axes of the adapter chucks located in the seatings changes with this adjustment.

DESCRIPTION OF THE PREFERRED EMBODIMENTS

Figure 1:
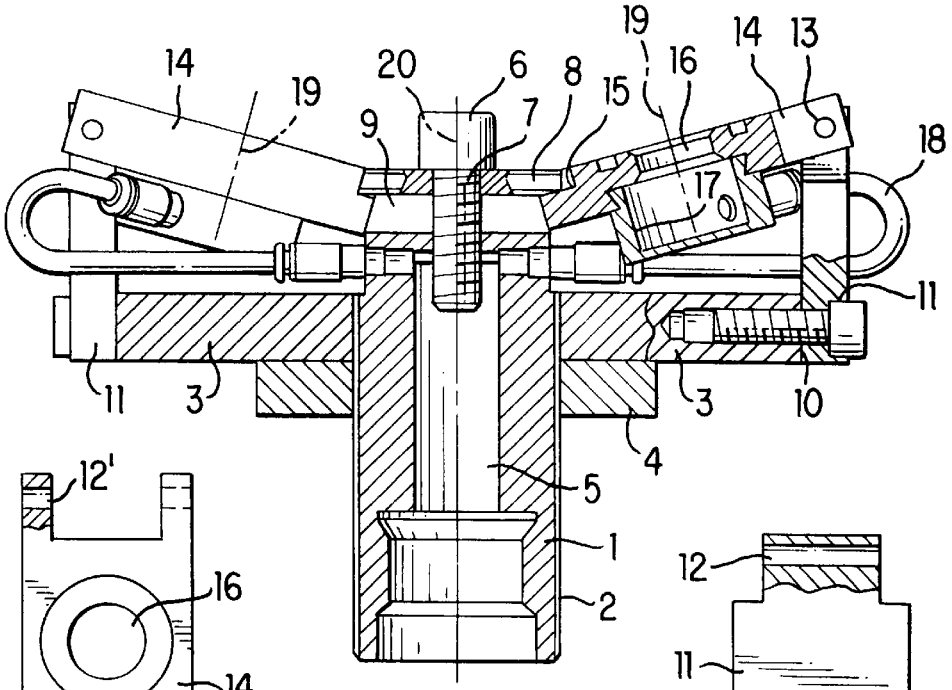
FIG. 1 shows a sectional view of the supporting device.

The supporting device shown in FIG. 1 contains a spindle shaft 1, which can be seated on the drive shaft of a grinding or polishing machine (not shown) The spindle shaft 1 is provided with an external thread 2, onto which a supporting plate 3 and a lock-nut 4 are screwed. The spindle shaft 1 contains a central bore 5 for the supply of vacuum or air or other gas. The terms "gas" and "air" as used herein mean any gas or combination of gases used in polishing or grinding processes. A screw 6 is driven into the head of the spindle shaft 1, the shank 7 of the screw forming together with a washer 8 a circumferential groove 9 on the head of the spindle shaft 1.

Figure 3:
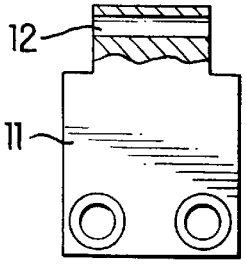
FIG. 3 shows a view of a support.
Figure 2:
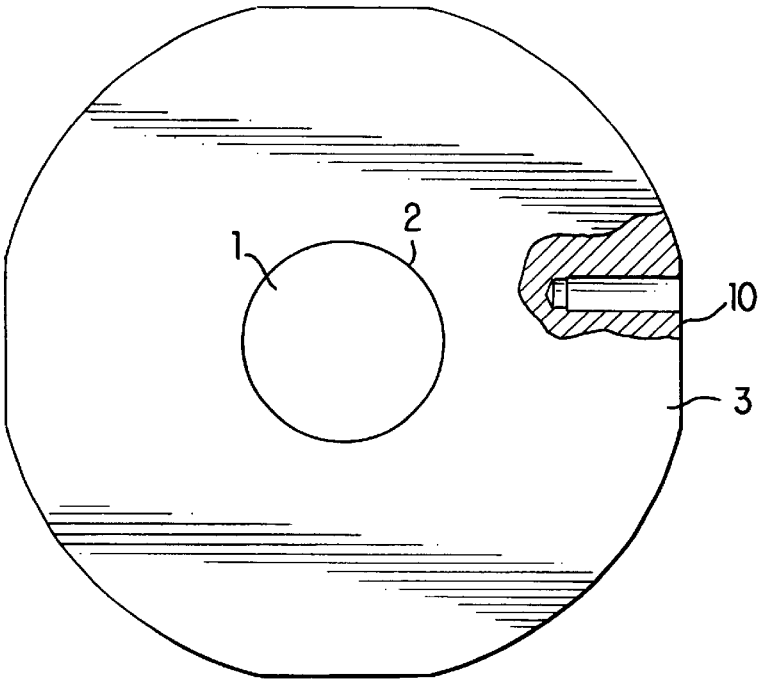
FIG. 2 shows a view of a supporting plate.

The supporting plate 3 is designed as a circular disk, which comprises four flattened portions 10 lying symmetrically relative to one another on its circumference, as shown in FIG. 2. Supports 11 are screwed onto these flattened portions 10. At their free ends, the supports 11 each have a bearing hole 12 to receive a bearing pin 13, as shown in FIG. 3. Depending on the diameter of the adapter chuck (not shown), different numbers of flattened portions 10 and supports 11 may be disposed on the supporting plate 3.

Figure 4:
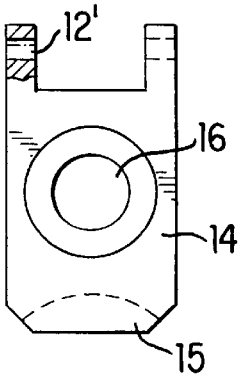
FIG. 4 shows a view of an arm.

Arms 14 are pivotably attached to the supports 11 via the bearing pins 13. For this purpose, the arms 14 likewise comprise bearing holes 12' at their forked ends, shown in FIG. 4, the bearing holes 12' being disposed flush with the bearing holes 12 of the supports 11.

Provided at the other end of each arm 14 is a stepped milled portion 15 which is adapted to the radius of the washer 8 and by means of which the arms 14 engage into the groove 9 at the head of the spindle shaft 1.

A seating 16 is provided in the surface of each arm 14, into which can be screwed, for example, commercially available adapter chucks (not shown in detail) for individual lens machining. The seatings 16 are each provided at the rear (or downward side in FIG. 1) with a pot-shaped cylinder 17, to which a flexible vacuum/gas line 18 is connected to provide a connection to the bore 5 in the spindle shaft 1.

In the view shown in FIG. 1, the axis 19 of the seatings 16 is tilted toward the axis 20 of the spindle shaft 1, so that axis 19 and axis 20 intersect in front of the supporting device. The bearing pin 13 is located in front of (or, as shown in FIG. 1, above) the groove 9, so that this is a working position in interaction with a convex hemispherical grinding or polishing tool.

After release of the lock-nut 4, the supporting plate 3 can be rotated (or unscrewed) downward on the spindle shaft 1 via external thread 2. When this occurs, the arms 14 run with their milled portion 15 in the groove 9 around the axis 20 of the spindle shaft 1. The flexible vacuum/gas lines 18 can be released from the pot-shaped cylinders 17 for this purpose. As a result of the lowering of the supporting plate 3, the bearing pins 13 also sink with the corresponding portions of arms 14. As the arms 14 are only resting in the groove 9, they can follow a changing angular position in the groove 9 unimpeded. The axis 19 of the seatings 16 is then increasingly directed away from the axis 20 of the spindle shaft 1 toward a working position for a flat surface machining, and ultimately to a working position for interaction with a concave hemispherical grinding or polishing tool. The supporting device described has proven especially useful in the machining of lens surfaces having a radius of at least ±50 mm.

The accuracy of the angular position of the arms 14 depends on the pitch and the play of the thread of the supporting plate 3 in the external thread 2. When an adapter chuck having elastic supporting elements is employed, discrepancies between the angular position of the surface of the optical component to be machined and the surface of the grinding or polishing tool are however compensated over a relatively large range of tolerance.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiment was chosen and described to explain the principles of the invention and as a practical application to enable one skilled in the art to utilize the invention in various embodiments and with various modifications suited to the particular use contemplated. It is intended that the scope of the invention be defined by the claims appended hereto and their equivalents.

LIST OF REFERENCES

1 Spindle shaft
2 External thread
3 Supporting plate
4 Lock-nut
5 Bore
6 Screw
7 Shank
8 Washer
9 Groove
10 Flattened portion
11 Support
12 Bearing hole
13 Bearing pin
14 Arm
15 Milled portion
16 Seating
17 Pot-shaped cylinder
18 Vacuum/gas line
19 Axis of the seating
20 Axis of the spindle shaft

What is claimed is:

1. A supporting device for a plurality of adapter chucks for the precision grinding or polishing of optical components, comprising:

a spindle shaft having a central bore for supplying one of a gas and a vacuum;

at least one arm adjustably supported by a head of the spindle shaft, adjustable as to its angle of inclination relative to an axis of the spindle shaft, and having a seating for an adapter chuck; and a flexible vacuum/gas line provided between the seating and the spindle shaft.

2. The support device as claimed in claim 1, further comprising a supporting plate, approximately symmetric relative to the axis of the spindle shaft, movably connected to the spindle shaft.

3. The support device as claimed in claim 2, wherein the supporting plate is an approximately circular disk.

4. The support device as claimed in claim 2, further comprising supports of the same number of arms, fixed on the periphery of the supporting plate, on each of which an outer end of a corresponding arm is pivotably connected.

5. The support device as claimed in claim 4, wherein a circumferential groove approximately perpendicular to the axis of the spindle shaft is provided on the head of the spindle shaft, in which an inner end of each arm is pivotably supported.

6. The support device as claimed in claim 5, wherein, when the supporting device comprises at least two arms, the supports and the arms are disposed symmetrically relative to the axis of the spindle shaft.

7. The support device as claimed in claim 5, wherein the supporting device has four arms and four supports.

8. The support device as claimed in claim 5, wherein the groove is formed between the head of the spindle shaft and a washer connected to the spindle shaft with a screw.

9. The support device as claimed in claim 8, wherein each arm has a stepped milled portion at its inner end having a radius of curvature approximately equal to that of the washer.

10. The support device as claimed in claim 5, wherein the spindle shaft comprises an external thread onto which the supporting plate can be screwed and fixed in desired positions relative to the spindle shaft.

11. The support device as claimed in claim 10, further comprising a lock-nut that can be screwed onto the spindle shaft for securing the supporting plate.

12. The support device as claimed in claim 1, wherein the spindle shaft is adapted to be connectable to a drive shaft of a grinding or polishing machine.

* * * * *